US005156723A

United States Patent [19]

Pliefke et al.

[11] Patent Number: 5,156,723

[45] Date of Patent: Oct. 20, 1992

[54] PROCESS FOR ELECTROCHEMICAL ROUGHENING OF ALUMINUM FOR PRINTING PLATE SUPPORTS

[75] Inventors: Engelbert Pliefke; Michael Brenk, both of Wiesbaden, Fed. Rep. of Germany

[73] Assignee: Hoechst Aktiengesellschaft, Frankfurt am Main, Fed. Rep. of Germany

[21] Appl. No.: 644,296

[22] Filed: Jan. 22, 1991

[30] Foreign Application Priority Data

Jan. 19, 1990 [DE] Fed. Rep. of Germany ..... 4001466

[51] Int. Cl.[5] ..... C25F 3/04

[52] U.S. Cl. ..... 204/129.75

[58] Field of Search ..... 204/129.75

[56] References Cited

U.S. PATENT DOCUMENTS

| | | | |
|---|---|---|---|
| 3,181,461 | 5/1965 | Fromson | 101/149.2 |
| 3,193,485 | 7/1965 | Vincent | 204/141 |
| 3,615,385 | 10/1971 | Lind | 96/1 |
| 3,632,486 | 1/1972 | Herrmann et al. | 204/33 |
| 3,653,886 | 4/1972 | Lind et al. | 96/1 R |
| 3,766,043 | 10/1973 | Herrmann et al. | 204/207 |
| 3,887,447 | 6/1975 | Sheasby et al. | 204/129 |
| 3,902,976 | 9/1975 | Walls | 204/38 |
| 3,929,591 | 12/1975 | Chu et al. | 204/17 |
| 3,963,594 | 6/1976 | Brasko | 204/129 |
| 3,980,539 | 9/1976 | Lloyd et al. | 204/129 |
| 4,049,504 | 9/1977 | Chu et al. | 204/38 |
| 4,052,275 | 10/1977 | Gumbinner et al. | 204/129 |
| 4,066,453 | 1/1978 | Lind et al. | 96/1 |
| 4,072,589 | 2/1978 | Golda et al. | 204/129 |
| 4,087,341 | 5/1978 | Takahashi et al. | 204/129 |
| 4,172,772 | 10/1979 | Ould et al. | 204/129 |
| 4,211,619 | 7/1980 | Usbeck | 204/33 |
| 4,229,226 | 10/1980 | Abelitis | 106/100 |
| 4,272,342 | 6/1981 | Oda et al. | 204/129 |
| 4,294,672 | 10/1981 | Ohba et al. | 204/129 |
| 4,301,229 | 11/1981 | Sakaki et al. | 430/158 |
| 4,324,841 | 4/1982 | Huang | 428/457 |
| 4,437,955 | 3/1984 | Shaffer | 204/129 |
| 4,518,471 | 5/1985 | Arora | 204/129 |
| 4,525,249 | 6/1985 | Arora | 204/129 |
| 4,655,136 | 4/1987 | Reiss et al. | 101/459 |
| 4,721,552 | 1/1988 | Huang et al. | 204/129 |
| 4,840,713 | 6/1989 | Pliefke | 204/129.75 |

FOREIGN PATENT DOCUMENTS

| | | |
|---|---|---|
| 0036672 | 9/1981 | European Pat. Off. . |
| 0131926 | 7/1987 | European Pat. Off. . |
| 3312496 | 10/1984 | Fed. Rep. of Germany . |
| 3503927 | 8/1986 | Fed. Rep. of Germany . |
| 3717654 | 12/1988 | Fed. Rep. of Germany . |
| 53-91334 | 7/1978 | Japan . |
| 53-123204 | 10/1978 | Japan . |
| 55-012877 | 4/1980 | Japan . |
| 57-16918 | 7/1982 | Japan . |
| 61-051396 | 3/1986 | Japan . |
| 81/1545 | 3/1982 | South Africa . |
| 879768 | 10/1961 | United Kingdom . |
| 944126 | 12/1963 | United Kingdom . |
| 1230447 | 5/1971 | United Kingdom . |
| 1440918 | 7/1975 | United Kingdom . |
| 1465926 | 3/1977 | United Kingdom . |
| 2019022 | 10/1979 | United Kingdom . |
| 2047274 | 11/1980 | United Kingdom . |
| 1582620 | 1/1981 | United Kingdom . |
| 2058136 | 4/1981 | United Kingdom . |
| 2060923 | 5/1981 | United Kingdom . |

OTHER PUBLICATIONS

"Ermittlung einer optimalen Wasserführung zur Steigerung der Leistungsfähigkeit des Offsetdrukes" J. Albrecht; W. Rebner and B. Wirz, Westdeutscher Verlag, Köln and Opladen, 1966, p. 7.

"Beitrag zur Analyse des Offsetprozesses [Contribution to the Analysis of the Offset Process]", P. Decker; Polygraph Verlag, Frankfurt am Main pp. 17 and 18.

"The Alternating Current Etching of Aluminum Lithographic Sheet"by A. J. Dowell in Transactions of the Institute of Metal Finishing, 1989, vol. 57, pp. 138 to 144.

M. Schenk, Werkstoff Aluminium und sein anodische Oxidation [The Material Aluminum and its Anodic Oxidation], Francke Verlag, Bern 1948, p. 760.

Praktsche Galvanotechnik [Electroplating in Practice], Eugen Leuitz Verlag, Saulgau 1970, p. 395 et seq., and pp. 518/519.

W. Hübner and C. T. Speiser, Die Praxis der anodischen Oxidation des Aluminiums [The Practice of Anodic Oxidation of Aluminum], Aluminium Verlag, Düsseldorf 1977, 3rd Ed., pp. 137 et seq.

*Primary Examiner*—T. M. Tufariello

*Attorney, Agent, or Firm*—Foley & Lardner

[57] ABSTRACT

A process for roughening aluminum or alloys thereof for printing plate supports, wherein an electrochemical roughening is performed by means of alternating current in an acidic electrolyte including sulfate ions and chloride ions, the chloride ions being in the form of aluminum chloride. In a preceding or subsequent roughenion stage, mechanical roughening and/or electrochemical roughening by means of alternating current in an electrolyte is carried out. The electrolyte can include hydrochloric acid and aluminum ions, nitric acid and aluminum ions or sulfuric acid and chloride ions.

40 Claims, No Drawings

PROCESS FOR ELECTROCHEMICAL ROUGHENING OF ALUMINUM FOR PRINTING PLATE SUPPORTS

BACKGROUND OF THE INVENTION

The present invention relates to a process for electrochemical roughening of aluminum for printing plate supports.

DE-A 3,717,654 discloses a process for electrochemical roughening of aluminum or aluminum alloys for printing plate supports by means of utilizing alternating current in an acidic electrolyte which contains sulfate ions and chloride ions, wherein the chloride ions are present in the form of aluminum chloride. Very uniform, scar-free support surfaces with fine roughening are obtained, which have excellent lithographic properties, but, precisely because of the fine roughening, the anchorage of the ink-bearing organic layer on the support is unsatisfactory. This leads to a shorter print run compared to a printing form in which a support is used which is produced by a process utilizing electrolytes which are free of sulfate ions but contain chloride ions or nitrate ions.

Printing plates, particularly offset printing plates, are comprised of a support and at least one radiation-sensitive layer located thereon, this layer being applied to the layer support by the customer in the case of non-precoated plates or by the industrial manufacturer in the case of precoated plates.

Aluminum or aluminum alloy has gained acceptance as a layer support in the printing plate field. These layer supports can, in principle, be used without a pretreatment, but they are, in general, treated in or on the surface, for example by mechanical, chemical and/or electrochemical roughening, a chemical or electrochemical oxidation and/or a treatment with agents conferring hydrophilic character. Chemical and electrochemical roughening is also referred to as "graining" or "etching".

In the modern, continuously operating high-speed installations of manufacturers of printing plate supports and/or precoated printing plates, a combination of the above-mentioned treatments frequently is employed, in particular, a combination of electrochemical roughening and anodic oxidation, if appropriate with a subsequent stage conferring hydrophilic character.

The roughening can be carried out in aqueous acids such as aqueous HCl or $HNO_3$ solutions or in aqueous salt solutions such as aqueous NaCl or $Al(NO_3)_3$ solutions, using alternating current. The peak-to-valley heights of the roughened surface, thus obtainable, expressed as mean peak-to-valley heights Rz, are in the range from 1 to 15 μm, especially in the range from 2 to 8 μm. The peak-to-valley height is determined according to DIN 4768 (October 1970). As the mean peak-to-valley height Rz, the arithmetic mean is calculated from the individual peak-to-valley heights of five adjacent individual measuring sections.

The roughening is carried out, inter alia, for improving the adhesion of the reproduction layer to the layer support and the damping water holding of the printing form produced from the printing plate by exposure and development.

Water holding is an important quality feature for offset printing plates. In the publication "Ermittlung einer optimalen Wasserführung zur Steigerung der Leistungsfähigkeit des Offsetdruckes [Determination of Optimum Water Holding for Improving the Performance of Offset Printing]" (J. Albrecht; W. Rebner and B. Wirz, Westdeutscher Verlag, Köln and Opladen, 1966, page 7), water holding is defined as the dosage and control of the damping of the printing form during the print run. The water holding depends, inter alia, on the surface roughness of the printing form, i.e., the graining of the surface. The problems of insufficient water holding are well-known. If too much water is required in order to keep the non-printing areas of a printing form free of ink, additional water can be emulsified into the ink, and the print becomes flat. Moreover, water marks can arise if the paper becomes moist. Furthermore, register problems can arise, and, in web-offset printing, there is an increased risk of the paper web tearing. Only some of the problems associated with water holding are mentioned here. Reference to the importance of proper water holding is also made in the publication "Beitrag zur Analyse des Offsetprozesses [Contribution to the Analysis of the Offset Process]", (P. Decker; Polygraph Verlag, Frankfurt am Main pages 17 and 18). In this publication, the consequences of too high and too low damping water holding are discussed. The term "damping water holding" is more appropriate than the term "water holding" because pure water is generally not used in offset printing for damping since several components typically are added to the water.

The disadvantages, already mentioned above, of excessive damping water are listed in the cited publications. An insufficient amount of damping water is also a disadvantage. If the printing plate is provided in the printing press with insufficient damping water because of too low a setting of the damping unit, or, if the printing plate requires more damping water than the damping unit of the printing press can supply due to structural limitations or other reasons, non-printing areas of the printing plate can also absorb ink and participate in printing, fine half-tone areas being particularly sensitive to participation in printing. The participation of non-image areas in printing within half-tone areas is known as "smearing."

What is desirable is thus a printing plate which requires only a small amount of damping water for keeping fine half-tones and large non-image areas free of ink, and, also demonstrates neutral behavior toward large quantities of damping water and still give excellent prints even if the damping water available temporarily exceeds the normal quantity due to fluctuations inherent in operation.

The damping water consumption of a printing plate can be measured objectively with sufficient accuracy, but not the damping water holding, since no objective measurement method exists for some of the above-mentioned disadvantageous phenomena such as, for example, smearing (P. Decker, in "Beitrag zur Analyse . . . [Contribution to the Analysis . . . ]", page 18). Therefore, the damping water holding of a printing plate herein is assessed qualitatively by the relative terms "very good", "good", "satisfactory", "adequate", "moderate", "poor" and "very poor."

Due to the exposure or irradiation and developing, or decoating in the case of electrophotographically operating reproduction layers, the image areas, which are ink-bearing during the later printing, and the damping water-bearing non-image areas, which in general represent the exposed support surface, are produced on the printing plate, whereby the actual printing form results. Widely different parameters affect the later topography and hence the damping water holding of the surface to be roughened. Information on this subject is provided, for example, in the literature references listed below.

In the article "The Alternating Current Etching of Aluminum Lithographic Sheet" by A. J. Dowell in (*Transactions of the Institute of Metal Finishing*), 1979, Volume 57, pages 138 to 144, the effects of varying the process parameters in the roughening of aluminum in aqueous hydrochloric acid solutions are investigated and discussed. The electrolyte composition is changed with repeated use of the electrolyte, for example, with respect to the $H^+(H_3O^+)$ ion concentration (measurable via the pH) and the $Al^{3+}$ ion concentration, and effects on the surface topography are observed. Varying the temperature variation between 16° C. and 90° C. effects the roughening only at about 50° C. and above, which manifests itself, for example, by a sharp decrease in layer formation on the surface. Utilization of a roughening time between 2 and 25 minutes leads, with increasing time of action, to increasing dissolution of metal. Varying the current density between 2 and 8 $A/dm^2$ results in higher roughness values with increasing current density. If the acid concentration is varied in the range from 0.17 to 3.3% of HCl, only insignificant changes in the hole structure arise between 0.5 and 2% of HCl, only local attack on the surface takes place below 0.5% of HCl, and irregular dissolution of aluminum takes place at high values. If pulsed direct current is used instead of alternating current, it is found that evidently both half-wave types are necessary for uniform roughening. Moreover, the article points out that the addition of sulfate ions increasingly leads to undesired, coarse, nonhomogeneously roughened structures which are unsuitable for lithographic purposes.

The use of hydrochloric acid for roughening substrates of aluminum is known. Uniform graining, which is suitable for lithographic plates and is within a useful roughness range, can be obtained in this way. A difficulty with pure hydrochloric acid electrolytes is adjusting the operating conditions to obtain a flat and uniform surface topography, and thus it is necessary to adhere to operating conditions within very narrow limits.

The influence of the composition of the electrolyte on the roughening quality is also described, for example, in the following publications:

United Kingdom Patent No. 1,400,918 mentions aqueous solutions having a content from 1.2 to 1.5% by weight of $HNO_3$ or from 0.4 to 0.6% by weight of HCl and, if appropriate, 0.4 to 0.6% by weight of $H_3PO_4$ as the electrolyte in the alternating current roughening of aluminum for printing plate supports, and U.S. Pat. No. 4,072,589 mentions aqueous solutions having a content from 0.2 to 1.0% by weight of HCl and 0.8 to 6.0% by weight of $HNO_3$ as the electrolyte in the alternating current roughening of aluminum.

Additives to the HCl electrolyte have the objective of preventing a disadvantageous, local attack in the form of deep holes. Thus, U.S. Pat. No. 4,172,772 describes the addition of monocarboxylic acids such as acetic acid to hydrochloric acid electrolytes, U.S. Pat. No. 3,963,594 describes the addition of gluconic acid, EP-A-0,036,672 describes the addition of citric acid and malonic acid, and U.S. Pat. No. 4,052,275 describes the addition of tartaric acid.

All these organic electrolyte constituents have the disadvantage that, at high current load which is to be equated to high voltage load, they are electrochemically unstable and decompose.

In DE-A 3,503,927, ammonium chloride is described as an inorganic additive to an HCl electrolyte.

Inhibiting additives, such as phosphoric acid or chromic acid as described in U.S. Pat. No. 3,887,447, and boric acid as described in U.S. Pat. No. 3,980,539, have the disadvantage that the protective action frequently collapses locally and individual, particularly pronounced scars correspondingly can form there.

Japanese Application 91,334/78 has disclosed alternating current roughening in an electrolyte of hydrochloric acid and an alkali metal halide to produce a lithographic support material.

In U.S. Pat. Nos. 3,632,486 and No. 3,766,043, direct current roughening in dilute hydrofluoric acid is mentioned, the Al strip being connected as the cathode.

Another known possibility for improving the roughening uniformity is modifying the type of current used, which includes, for example, alternating current, wherein the anode voltage and the anodic Coulomb input are greater than the cathode voltage and the cathodic Coulomb input according to U.S. Pat. No. 4,087,341, the anodic half period of the alternating current being in general adjusted to be less than the cathodic half period; this method is also referred to, for example, in U.S. Pat. Nos. 4,301,229 and No. 4,272,342 and United Kingdom Patent No. 2,047,274 alternating current, wherein the anode voltage is markedly increased as compared with the cathode voltage according to U.S. Pat. No. 3,193,485 and interruption of the alternating current flow for 10 to 120 seconds or 30 to 300 seconds, wherein the electrolyte is an aqueous 0.75 to 2 N HCl solution which includes a NaCl or $MgCl_2$ additive, according to United Kingdom Patent No. 879,768. A similar process with an interruption of the current flow in the anode phase or cathode phase is also described in U.S. Pat. No. 4,294,672.

Though the above-discussed methods provide relatively uniformly roughened aluminum surfaces, they require relatively very expensive equipment and are operable only within very narrow parameter limits.

Another known procedure is the combination of two roughening processes. This has the advantage over a single-stage process in that, depending on the process method, the influence of one or the other stage can predominate within certain limits predetermined by the properties of the individual stages.

According to the methods described in U.S. Pat. No. 3,929,591; United Kingdom Patent No. 1,582,620; JP-A 123,204/78; United Kingdom Patents No. 2,058,136 and No. 2,060,923; EP-A 0,131,926; United Kingdom Patent No. 2,047,274 and JP-B 16,918/82, the combination of prestructuring occurs mechanically in the first step, followed by chemical cleaning (pickling), which may be carried out with electrochemical roughening by means of modified alternating current in electrolytes containing hydrochloric acid or nitric acid, it being possible for a further cleaning step then to take place.

These processes exploit the advantage of double roughening, with mechanical roughening as the first step, whereby especially a saving in current is achieved.

For the manufacture of capacitors from aluminum foils, various two-stage processes are known. In U.S. Pat. No. 4,525,249, a process is described which uses hydrochloric acid in the first stage and in which the aluminum foil, in the second stage, is treated currentlessly with a dilute nitric acid which additionally contains aluminum in the form of aluminum nitrate. This process does not give surfaces which can satisfy the stringent requirements presently demanded for offset printing plates.

Two-stage processes which use electrochemical methods in both stages have also been disclosed. In the process according to U.S. Pat. No. 4,721,552, the first electrolyte contains hydrochloric acid, whereas the second electrolyte can also contain hydrochloric acid in addition to nitric acid. A similar process is described in Japanese Publication JP 61 051,396. Although these known processes give surfaces useful for lithographic purposes, the fineness of their surface structure does not reach that which is obtained according to the teaching of German Offenlegungsschrift No. 3,717,654.

U.S. Pat. No. 4,437,955 discloses a two-stage electrochemical roughening process for the manufacture of capacitors, employing an electrolyte containing hydrochloric acid in the first step and an electrolyte containing chloride ions and sulfate ions in the second step. The electrolyte of the second stage is not acidic, and direct current is used in this stage.

A further two-stage electrochemical process for manufacturing a capacitor foil is described in U.S. Pat. No. 4,518,471. The electrolytes in both baths are identical and contain dilute hydrochloric acid and aluminum ions. The baths are operated at different temperatures, namely, at 70° to 85° C. in the first stage and at 75° to 90° C. in the second stage.

The surfaces produced in the two last-mentioned processes, optimized for electrolyte capacitors, are too scarred for application in lithography.

SUMMARY OF THE INVENTION

It is therefore an object of the present invention to provide a process for roughening aluminum for printing plate supports wherein, in addition to a uniform, very fine, scar-free, roughened structure of the aluminum surface of the printing plate supports, very good reprographic and printing technology properties, in particular long print runs from the finished printing forms, are obtained. It is a further object of the present invention to provide a process which permits the production of supports whose properties are controllable within wide ranges, thus enabling manufacturing of differently structured surfaces of the printing plate supports according to particular design specifications without plant engineering modifications.

In accomplishing the foregoing objects there is provided according to the present invention a process for roughening an aluminum or aluminum alloy substrate for a printing plate support, comprising: (a) a primary roughening stage which comprises immersing said substrate in an acidic first electrolyte comprising sulfate ions and chloride ions, and applying an alternating current to said first electrolyte; and (b) a secondary roughening stage which comprises performing at least one roughening step selected from the group consisting of mechanically roughening said substrate, immersing said substrate in a second electrolyte comprising hydrochloric acid and aluminum ions, immersing said substrate in a third electrolyte comprising nitric acid and aluminum ions, and immersing said substrate in a fourth electrolyte comprising sulfuric acid and chloride ions, wherein an alternating current is applied to said second, third and fourth electrolytes. The primary roughening stage can be performed prior or subsequent to the secondary roughening stage.

Further objects, features and advantages of the present invention will become apparent from the detailed description of preferred embodiments that follows.

DETAILED DESCRIPTION OF THE PREFERRED EMBODIMENTS

The present invention comprises a combined or multi-stage process for the roughening of aluminum. Preferably, a two-stage roughening process is employed. In one stage of the present process, an electrolyte is employed which includes sulfate ions in a relatively high concentration of about 5 to 100 g/l and chloride ions, which are present in the form of aluminum chloride. Hereinafter, this stage is referred to as the "primary roughening stage." Before or after the primary roughening stage, roughening in hydrochloric acid, nitric acid or sulfuric acid-containing electrolytes and/or mechanical roughening is carried out. Hereinafter, this roughening is referred to as the "secondary roughening stage."

In the secondary roughening stage, the electrolyte employed can be an electrolyte which includes chloride ions but is substantially free of sulfate ions.

If desired, an acidic or alkaline cleaning can be carried out before the first roughening stage, between the two roughening stages and/or after the second roughening stage.

Surprisingly, it has been discovered that according to the present invention, outstanding printing properties, such as a longer print run, are added to the excellent reprographic properties and the good damping water holding which are characteristic of a support produced in sulfate-containing electrolytes, such as that described in DE-A 3,717,654. Though supports having good reprographic qualities can be produced utilizing the process described in DE-A 3,717,654, printing forms produced with these supports do not reach the long print runs obtained by plates whose supports are produced by a process in which an electrolyte based on nitric acid is used.

Printing forms whose supports are produced according to one of the previously mentioned processes, with the exception of the process described in DE-A 3,717,654, have poorer reprographic properties and poorer damping water holding than the printing plate supports produced according to the present invention.

According to the present invention, the primary roughening stage comprises roughening in an electrolyte containing sulfate ions and chloride ions, the sulfate ion concentration being about 5 to 100 g/l and the chloride ion concentration being about 1 to 100 g/l. The primary roughening stage is combined with a further or secondary roughening stage.

A range from about 20 to 50 g/l of sulfate ions and about 10 to 70 g/l of chloride ions is preferred in the primary roughening stage. The sulfate can be introduced as sulfuric acid and the chloride can be introduced as aluminum chloride into the electrolyte.

Higher chloride ion concentrations reinforce the local attack on the aluminum surface and give undesired scars. Combinations of different compounds containing chloride ions are also within the scope of the present invention.

The preceding or subsequent secondary roughening stage can be carried out, for example, in an electrolyte which includes about 1 to 20 g/l of hydrochloric acid (calculated as 100% HCl) and about 10 to 200 g/l of $Al^{3+}$ ions introduced as aluminum chloride. In this embodiment of the secondary roughening stage, the electrochemical roughening typically is carried out at a temperature of about 35° to 55° C., at current densities from about 20 to 150 A/dm$^2$ and, depending on the current density, for a period of about from 5 seconds to 200 seconds.

The secondary roughening stage can likewise take place in an electrolyte which includes, for example, about 20 to 35 g/l of $HNO_3$ and about 30 to 50 g/l of $Al^{3+}$ ions introduced as aluminum nitrate. In this embodiment of the secondary roughening stage, the electrochemical roughening preferably is carried out at temperatures from about 22° to 50° C. and with current densities from about 15 to 80 A/dm$^2$, for a period of about 2 to 100 seconds.

The secondary roughening stage can also comprise employing an electrolyte which includes sulfate ions and chloride ions. The concentration of the sulfate ions and chloride ions preferably is similar to the concentrations used in the primary roughening stage.

Mechanical graining can also be utilized as the secondary roughening stage. Mechanical graining can include roughening with moist abrasives (wet brushing), and dry roughening, for instance, by means of wire brushes, sandblasting, bead graining, embossing and similar methods. Mechanical roughening should be followed by thorough pickling in acidic or alkaline media.

The surface produced by the process according to the present invention is a highly uniform support surface having excellent lithographic properties and peak-to-valley ranges which are variable for Rz of about 3 to 9 and which additionally, as required, can be adapted to specific product specifications without modification of the production plants.

The present process can be carried out discontinuously or continuously, using strips of aluminum or alloys thereof. In general, the process parameters in the continuous process are within the following ranges during the primary roughening stage: the temperature of the electrolyte is between about 20° and 60° C., the current density is between about 3 and 180 A/dm$^2$; the residence time of an area of material to be roughened in the electrolyte is between about 10 and 300 seconds; and the electrolyte flow velocity on the surface of the material to be roughened between is about 5 and 100 cm/second. The continuous procedure and simultaneous release of Al ions and consumption of $H^+$ requires a continuous readjustment of the electrolyte composition via the corresponding dilute acids.

In the discontinuous process, the required current densities are between about 3 and 40 A/dm$^2$ and the residence times are between about 30 and 300 seconds. In this embodiment, it is possible to dispense with the flow of the electrolytes.

In addition to sinusoidal alternating voltages at mains frequency, superposed alternating voltages and voltages of a frequency lower than the mains frequency can also be used. Mains frequency herein is understood to be the frequency of the voltage supplied from the main or standard power source.

The following materials, for example, can be roughened in the form of a plate, foil or strip:

"Pure aluminum" (DIN Material No. 3.0255), i.e., consisting of more than about 99.5% of Al and the following permissible impurities of (maximum total of about 0.5%) about 0.3% of Si, about 0.4% of Fe, about 0.03% of Ti, about 0.02% of Cu, about 0.07% of Zn and about 0.03% of others, or "Al alloy 3003" (comparable with DIN material No. 3.0515), i.e., comprised of more than about 98.5% of Al, the alloy constituents of about 0 to 0.3% of Mg and about 0.8 to 1.5% of Mn and the following permissible impurities of about 0.5% of Si, about 0.5% of Fe, about 0.2% of Ti, about 0.2% of Zn, about 0.1% of Cu and about 0.15% of others.

The present process is also applicable for other aluminum alloys.

After the primary and secondary roughening stages, an anodic oxidation of the support can be performed, for example, whereby the abrasion and adhesion properties of the surface of the support material are improved.

Conventional electrolytes such as sulfuric acid, phosphoric acid, oxalic acid, amidosulfonic acid, sulfosuccinic acid, sulfosalicylic acid or mixtures thereof can be used for the anodic oxidation. Reference is made, for example, to the following standard methods for the anodic oxidation of aluminum (in this connection, see e.g. M. Schenk, Werkstoff Aluminium und seine anodische Oxidation [The Material Aluminum and its Anodic Oxidation], Francke Verlag, Bern 1948, page 760; Praktische Galvanotechnik [Electroplating in Practice], Eugen Leutze Verlag, Saulgau 1970, pages 395, et seq., and pages 518/519; W. Hübner and C. T. Speiser, Die Praxis der anodischen Oxidation des Aluminiums [The Practice of the Anodic Oxidation of Aluminum], Aluminium Verlag, Düsseldorf 1977, 3rd Edition, pages 137 et seq.):

The direct current sulfuric acid process, in which the anodic oxidation is carried out in an aqueous electrolyte of usually about 230 g of $H_2SO_4$ per 1 liter of solution at about 10° to 22° C. and a current density of about 0.5 to 2.5 A/dm$^2$ for about 10 to 60 minutes. The sulfuric acid concentration in the aqueous electrolyte solution can also be reduced to about 8 to 10% by weight of $H_2SO_4$ (about 100 g/l of $H_2SO_4$) or also increased to about 30% by weight (365 g/l of $H_2SO_4$) and more.

"Hard anodizing", which is carried out with an aqueous electrolyte, containing $H_2SO_4$, of a concentration of about 166 g/l of $H_2SO_4$ (or about 230 g/l of $H_2SO_4$) at an operating temperature from about 0° to 5° C., at a current density from about 2 to 3 A/dm$^2$, a voltage rising from about 25 to 30 V at the start to about 40 to 100 V toward the end of the treatment and for about 30 to 200 minutes.

Apart from these processes, for the anodic oxidation of printing plate support materials the following processes can also be utilized, for example, the anodic oxidation of aluminum in an aqueous electrolyte which includes $H_2SO_4$ and whose $Al^{3+}$ ion content is adjusted to values of more than about 12 g/l as described in U.S. Pat. No. 4,211,619, in an aqueous electrolyte containing $H_2SO_4$ and $H_3PO_4$ as described in U.S. Pat. No. 4,049,504, or in an aqueous electrolyte containing $H_2SO_4$, $H_3PO_4$ and $Al^{3+}$ ions as described in U.S. Pat. No. 4,229,226.

Direct current preferably is employed for the anodic oxidation, but alternating current or a combination of these current types, e.g., direct current with superposed alternating current can also be used. The layer weights of alumina are in the range from about 1 to 10 g/m$^2$, corresponding to a layer thickness of about 0.3 to 3.0 μm.

After the primary and secondary roughening stages and before the anodic oxidation, a modifying treatment which effects a superficial ablation of the roughened surface, can also be applied, such as is described, for example, in DE-A 3,009,103. Such a modifying intermediate treatment provides, inter alia, the build-up of abrasion-resistant oxide layers and a lower tendency towards toning during the later printing.

The anodic oxidation of the printing plate support material of aluminum can also be followed by one or more aftertreatment stages. Aftertreating herein is understood to be a chemical or electrochemical treatment conferring hydrophilic character on the alumina layer, for example, dipping the material in an aqueous polyvinylphosphonic acid solution according to United Kingdom Patent No. 1,230,447, dipping in an aqueous alkali metal silicate solution according to U.S. Pat. No. 3,181,461 or an electrochemical treatment (anodizing) in an aqueous alkali metal silicate solution according to U.S. Pat. No. 3,902,976. These aftertreatment stages especially provide a further additional increase in the hydrophilic character of the alumina layer, already sufficient for many fields of application, without impairing the other known properties of this layer.

Any light-sensitive reproduction layers which, after exposure, subsequent development and/or fixing, give an imagewise surface, from which printing is possible, and/or which represent a relief image of an original, can be utilized in association with a support produced according to the present invention. The reproduction layers are applied, either by the manufacturer of presensitized printing plates by means of a dry resist or directly by the user, to one of the conventional support materials.

The light-sensitive reproduction layers include the following which are described, e.g., in "Light-Sensitive Systems" by Jaromir Kosar, published by John Wiley & Sons, New York 1965: layers which include unsaturated compounds and in which these compounds are isomerized, rearranged, cyclized or crosslinked on exposure (Kosar, Chapter 4) such as, e.g. cinnamates; layers which include photopolymerizable compounds and in which monomers or prepolymers polymerize on exposure, if necessary by means of an initiator (Kosar, Chapter 5); and layers including o-diazo-quinones such as naphthoquinone-diazides, p-diazo-quinones or diazonium salt condensates (Kosar, Chapter 7).

These suitable layers also include electrophotographic layers, i.e., those having an inorganic or organic photoconductor. In addition to the light-sensitive substances, these layers can, of course, also include other constituents such as, e.g., resins, dyes, pigments, wetting agents, sensitizers, adhesion promoters, indicators, plasticizers or other conventional additives.

Photo-semiconducting layers such as are described, e.g., in DE-C 1,117,391, 1,522,497, 1,572,312, 2,322,046 and 2,322,047, can also be applied to the support materials, whereby highly light-sensitive electrophotographic layers are formed.

The printing plate support materials roughened by the process according to the present invention display a very uniform topography, which has a very positive influence on the print run stability and the damping water holding during printing from printing forms produced from these supports. Undesired "scars", which form prominent depressions as compared with the surrounding roughening, occur less frequently, and these may even be completely suppressed. In particular, the process makes it possible to produce a very wide spectrum of supports roughened to different extents, which can be seen from the achievable peak-to-valley heights of Rz of about 3 μm to 9 μm. This is achieved without having to make modifications to the apparatus in production plants.

EXAMPLES

An aluminum sheet is first pickled for 60 seconds at room temperature in an aqueous solution containing 20 g/l of NaOH. The roughening is then carried out in the electrolyte systems indicated for each example.

The division into the qualitative classes, taking into account the surface topography in relation to uniformity, freedom from scars and surface coverage, is determined by visual assessment under the microscope, the quality level "10" (best value) being given to a homogeneously roughened and scar-free surface. A surface having thick scars of a size of more than 30 μm and/or an extremely non-uniformly roughened or almost bright-rolled surface is given the quality level "0" (poorest value). The following roughening methods are applied:

A-wire brushing,

B-wet brushing,

C-electrochemical roughening in an electrolyte which includes 10 g/l of HCl (calculated as 100%) and 65 g/l of aluminum chloride ($AlCl_3 \cdot 6H_2O$) at a temperature of 35° C., D-electrochemical roughening in an electrolyte which contains 9 g/l of nitric acid (calculated as 100%) and 67 g/l of aluminum nitrate ($Al[NO_3]_3 \cdot 9H_2O$) at a temperature of 40° C., E-electrochemical roughening in an electrolyte which contains 28 g/l of sulfuric acid and 100 g/l of aluminum chloride ($AlCl_3 \cdot 6H_2O$), at a temperature of 45° C. and F-electrochemical roughening in an electrolyte which contains 25 g/l of sulfuric acid and 130 g/l of aluminum chloride ($AlCl_3 \cdot 6H_2O$), at a temperature of 40° C.

Table 1 shows results obtained using various embodiments of the process according to the present invention.

Column 1 in Table 1 gives the roughening process used in the first step, columns 2 and 3 give the roughening time and the current density, if applicable. Column 5 gives the roughening process used in the second step, columns 6 and 7 give the roughening time and, if applicable, the current density, column 8 gives the Rz value explained above, which is a measure of the roughness, and column 9 indicates the quality classification of the support.

Between the two roughening steps, the supports can also be pickled. In this case, the pickling solution used at room temperature (=22° C.) is an aqueous solution of about 20 g/l of NaOH and 2 g/l of sodium carbonate (anhydrous). The dipping times, if applicable, are indicated in column 4 of Table 1.

The process steps in the following Table 1, as entered in columns 1 and 5, correspond to the roughening methods A–F listed above.

TABLE 1

| | 1st Roughening Step | | | | 2nd Roughening Step | | | | |
|---|---|---|---|---|---|---|---|---|---|
| | 1 | 2 | 3 | 4 | 5 | 6 | 7 | 8 | 9 |
| No. | Process | Time Sec | Current density A/dm² | Pickling time sec | Process | Time Sec | Current density A/dm² | Rz μm | Rating |
| 1 | C | 20 | 100 | — | F | 15 | 40 | 5.65 | 7 |
| 2 | C | 20 | 100 | — | F | 20 | 40 | 6.12 | 7 |
| *3 | C | 20 | 100 | — | F | 25 | 40 | 7.14 | 7 |
| 4 | C | 20 | 100 | — | F | 30 | 40 | 8.00 | 6 |
| 5 | C | 15 | 120 | — | F | 10 | 60 | 8.09 | 6 |
| 6 | B | | | 60 | F | 15 | 40 | 7.09 | 6 |
| 7 | B | | | 60 | F | 20 | 40 | 6.99 | 7 |
| 8 | B | | | 60 | F | 25 | 40 | 7.52 | 6 |
| 9 | B | | | 60 | F | 30 | 40 | 7.90 | 6 |
| 10 | B | | | 60 | F | 10 | 60 | 5.92 | 8 |
| 11 | B | | | 60 | F | 13 | 60 | 5.89 | 6 |
| 12 | B | | | 60 | F | 7 | 80 | 6.07 | 8 |
| 13 | B | | | 60 | F | 10 | 80 | 6.17 | 6 |
| 14 | A | | | — | F | 25 | 40 | 9.25 | 5 |
| 15 | A | | | — | F | 30 | 40 | 9.94 | 6 |
| 16 | A | | | — | F | 10 | 60 | 7.77 | 5 |
| 17 | A | | | — | F | 13 | 60 | 8.13 | 6 |
| 18 | C | 20 | 100 | — | E | 15 | 40 | 6.02 | 8 |
| 19 | C | 20 | 100 | — | E | 20 | 40 | 5.95 | 8 |
| 20 | C | 15 | 120 | — | E | 25 | 40 | 5.98 | 8 |
| 21 | C | 25 | 90 | — | E | 30 | 40 | 5.87 | 8 |
| 22 | C | 20 | 100 | — | E | 10 | 60 | 5.76 | 7 |
| 23 | C | 20 | 100 | — | E | 13 | 60 | 6.41 | 7 |
| 24 | C | 20 | 100 | — | E | 17 | 60 | 7.03 | 7 |
| 25 | B | | | 30 | E | 6 | 100 | 8.28 | 6 |
| 26 | B | | | 30 | E | 8 | 100 | 8.74 | 6 |
| 27 | A | | | 60 | E | 13 | 80 | 9.69 | 7 |
| 28 | A | | | 60 | E | 15 | 80 | 9.35 | 8 |
| 29 | A | | | 60 | E | 6 | 100 | 8.07 | 8 |
| 30 | A | | | 60 | E | 8 | 100 | 8.17 | 7 |
| 31 | D | 30 | 60 | | E | 10 | 40 | 4.35 | 7 |
| 32 | D | 30 | 60 | | E | 15 | 40 | 5.23 | 7 |
| 33 | D | 30 | 60 | | E | 13 | 60 | 5.93 | 6 |
| 34 | D | 30 | 60 | | E | 10 | 80 | 5.82 | 7 |
| 35 | D | 30 | 60 | | F | 10 | 40 | 3.62 | 7 |
| 36 | E | 15 | 40 | | F | 15 | 40 | 4.93 | 8 |
| 37 | E | 10 | 80 | | F | 13 | 60 | 5.66 | 7 |
| 38 | E | 30 | 60 | | F | 15 | 60 | 6.85 | 6 |
| 39 | E | 10 | 40 | — | D | 15 | 40 | 5.05 | 10 |
| 40 | E | 10 | 40 | — | D | 20 | 40 | 5.45 | 10 |
| 41 | E | 10 | 40 | — | D | 10 | 60 | 6.42 | 8 |
| 42 | E | 10 | 40 | — | D | 20 | 60 | 7.31 | 8 |
| 43 | F | 8 | 35 | — | D | 15 | 40 | 5.67 | 9 |
| 44 | F | 8 | 35 | — | D | 20 | 40 | 6.02 | 9 |
| 45 | E | 8 | 35 | — | D | 7 | 80 | 8.20 | 7 |
| 46 | E | 10 | 40 | — | C | 15 | 40 | 8.88 | 6 |
| 47 | E | 10 | 40 | — | C | 20 | 40 | 8.97 | 6 |
| 48 | E | 10 | 40 | — | C | 13 | 60 | 6.21 | 7 |
| 49 | E | 10 | 40 | — | C | 17 | 60 | 6.45 | 7 |
| 50 | F | 8 | 35 | — | C | 15 | 40 | 7.85 | 7 |
| 51 | F | 8 | 35 | — | C | 17 | 60 | 8.21 | 8 |
| 52 | F | 10 | 40 | — | C | 15 | 40 | 8.54 | 8 |
| 86 | F | 15 | 80 | — | E | 10 | 40 | 4.35 | 9 |
| 87 | F | 20 | 80 | — | E | 15 | 40 | 5.67 | 8 |
| 88 | E | 15 | 80 | — | F | 13 | 60 | 5.79 | 10 |
| 89 | E | 20 | 80 | — | F | 15 | 60 | 6.34 | 9 |

Table 2 shows comparative examples of supports which were not produced by a process according to the present invention. Alkaline pickling, which was carried out for all the comparative supports between the first and the second roughening step, is not specifically shown in Table 2. With respect to the comparative examples, the pickling solution used at room temperature (=22° C.) was an aqueous solution of about 20 g/l of NaOH and about 2 g/l of sodium carbonate (anhydrous). The dipping time was about 30 seconds throughout. Neither of the two roughening steps was carried out in an electrolyte which has the above-described composition of about 5 to 100 g/l of sulfate ions an amount of chloride ions, for example, in the form of Al chloride. The poorer quality of the resulting supports is demonstrated in Table 2.

TABLE 2

| | 1st Roughening Step | | | 2nd Roughening Step | | | | |
|---|---|---|---|---|---|---|---|---|
| No. | Process | Time Sec | Current Density A/dm² | Process | Time Sec | Current Density A/dm² | Rz μm | Rating |
| V53 | A | | | B | 10 | 40 | 4.56 | 2 |
| V54 | A | | | C | 15 | 80 | 5.64 | 1 |

TABLE 2-continued

| | 1st Roughening Step | | | 2nd Roughening Step | | | | |
|---|---|---|---|---|---|---|---|---|
| No. | Process | Time Sec | Current Density A/dm² | Process | Time Sec | Current Density A/dm² | Rz µm | Rating |
| V55 | A | | | D | 13 | 40 | 4.23 | 0 |
| V56 | B | | | A | 7 | 80 | 6.43 | 1 |
| V58 | B | | | D | 6 | 40 | 3.56 | 2 |
| V59 | C | 8 | 70 | A | | | 3.56 | 1 |
| V60 | C | 12 | 75 | B | | | 4.56 | 2 |
| V61 | C | 20 | 60 | D | 6 | 40 | 6.78 | 1 |
| V62 | D | 6 | 40 | A | | | 4.35 | 0 |
| V63 | D | 8 | 35 | B | | | 5.65 | 2 |
| V64 | D | 12 | 30 | C | 7 | 80 | 7.83 | 1 |

Aluminum sheets were roughened according to the present invention in two stages by the processes described in Table 3 and anodized for 30 seconds in sulfuric acid (100 g/l) at 30° C. and a current density of 5 A/dm².

TABLE 3

| | 1st Roughening Step | | | 2nd Roughening Step | | | | |
|---|---|---|---|---|---|---|---|---|
| No. | Process | Time Sec | Current Density A/dm² | Process | Time Sec | Current Density A/dm² | Water Holding | Print Run in 1000 |
| 65 | D | 30 | 60 | F | 10 | 60 | GOOD | 210 |
| 66 | D | 10 | 60 | F | 30 | 60 | VERY GOOD | 140 |
| 67 | F | 10 | 60 | D | 30 | 60 | GOOD | 190 |
| 68 | F | 30 | 60 | D | 10 | 60 | VERY GOOD | 130 |
| 90 | F | 15 | 70 | E | 10 | 40 | VERY GOOD | 140 |
| 91 | E | 20 | 80 | F | 13 | 60 | GOOD | 170 |

The plates were then coated with a solution having the following composition:

| | |
|---|---|
| 6.6 parts by weight | Cresol/formaldehyde novolak (having a softening range of 105–120° C. according to DIN 53 181), |
| 1.1 parts by weight | of 4-(2-phenyl-prop-2-yl)-phenyl 1,2-naphthoquinone-2-diazide-4-sulfonate, |
| 0.6 part by weight | of 2,2'-bis-(1,2-naphthoquinone-2-diazide-5-sulfonyloxy)-1,1'-dinaphthylmethane, |
| 0.24 part by weight | of 1,2-naphthoquinone-2-diazide-4-sulfochloride, |
| 0.08 part by weight | of crystal violet and |
| 91.36 parts by weight | of a solvent mixture of 4 parts by volume of ethylene glycol monomethyl ether, 5 parts by volume of tetrahydrofuran and 1 part by volume of butyl acetate |

The coated supports were dried in a drying tunnel at temperatures up to 120° C. The printing plates thus produced were exposed under a positive original and developed using a developer of the following composition:

| | |
|---|---|
| 5.3 parts by weight | of sodium metasilicate · $9H_2O$ |
| 3.4 parts by weight | of trisodium phosphate |
| 0.3 part by weight | of sodium dihydrogen phosphate (anhydrous) and |
| 91.0 parts by weight | of water. |

Printing was carried out with the developed plates, and the plates were tested with respect to print run and damping water holding. It was found that these properties can be influenced in the desired way by controlling the two stages of the roughening process and are good throughout.

For comparison, some supports were roughened by known processes. The particular roughening methods employed can be seen from Table 4. The supports correspond to the comparative examples listed in Table 2. These plates too were coated with a solution of the composition indicated above, exposed, developed and used for printing. It was found that, even though the damping water holding in some comparative examples (V72, V73, V75 and V76) was only slightly poorer than in the process according to the present invention, the print run was markedly shorter. Although the print run range of the printing plates produced according to the present invention was reached with the plates of the other comparative examples, the damping water consumption was markedly higher than in the case of the printing plates produced by the process according to the present invention.

TABLE 4

| | 1st Roughening Step | | | 2nd Roughening Step | | | | |
|---|---|---|---|---|---|---|---|---|
| No. | Process | Time Sec | Current Density A/dm² | Process | Time Sec | Current Density A/dm² | Water Holding | Print Run in 1000 |
| V69 | A | | | B | 10 | 40 | SATISFACTORY | 40 |
| V70 | A | | | C | 15 | 80 | SATISFACTORY | 60 |
| V71 | A | | | D | 13 | 40 | POOR | 120 |
| V72 | B | | | A | | | GOOD | 25 |
| V73 | B | | | C | 7 | 80 | GOOD | 55 |
| V74 | B | | | D | 6 | 40 | MODERATE | 65 |
| V75 | C | 8 | 70 | A | | | GOOD | 40 |
| V76 | C | 12 | 75 | B | | | GOOD | 65 |
| V77 | C | 20 | 60 | D | 6 | 40 | POOR | 95 |
| V78 | D | 6 | 40 | A | | | MODERATE | 80 |
| V79 | D | 8 | 35 | B | | | SATISFACTORY | 45 |
| V80 | D | 12 | 30 | C | 7 | 80 | MODERATE | 110 |

Even if the roughening processes C or D are modified, the surfaces of the printing plate supports cannot be equated to the support surfaces obtainable by the process according to the present invention, as is evident from Table 5. Modified roughening processes:

CC-electrochemical roughening in an electrolyte which includes 15 g/l of HCl (calculated as 100%) and 30 g/l of aluminum chloride ($AlCl_3 \cdot 6H_2O$), at a temperature of 55° C., CCC-electrochemical roughening in an electrolyte which includes 6 g/l of HCl (calculated as 100%) and 90 g/l of aluminum chloride ($AlCl_3 \cdot 6H_2O$), at a temperature of 30° C., DD-electrochemical roughening in an electrolyte which includes 20 g/l of nitric acid (calculated as 100%) and 43 g/l of aluminum nitrate ($Al[NO_3]_3 \cdot 9H_2O$), at a temperature of 60° C., and DDD-electrochemical roughening in an electrolyte which includes 6 g/l of nitric acid (calculated as 100%) and 115 g/l of aluminum nitrate ($Al[NO_3]_3 \cdot 9H_2O$), at a temperature of 35° C.

TABLE 5

| | 1st Roughening Step | | | 2nd Roughening Step | | | | |
|---|---|---|---|---|---|---|---|---|
| No. | Process | Time Sec | Current Density A/dm² | Process | Time Sec | Current Density A/dm² | Water Holding | Print Run in 1000 |
| V81 | D | 10 | 40 | CC | 20 | 80 | VERY POOR | 120 |
| V82 | DD | 10 | 40 | CC | 20 | 80 | POOR | 90 |
| V83 | DDD | 10 | 40 | CC | 20 | 80 | MODERATE | 75 |
| V84 | CCC | 20 | 80 | DD | 10 | 40 | MODERATE | 60 |
| V85 | CC | 20 | 80 | DDD | 10 | 40 | POOR | 70 |

What is claimed is:

1. A process for roughening an aluminum or aluminum alloy substrate for a printing plate support, comprising:

a) a primary roughening stage which comprises immersing said substrate in a first electrolyte comprising sulfate ions and aluminum chloride which provides chloride ions, and applying an alternating current to said first electrolyte; and b) a secondary roughening stage which comprises performing at least one roughening step selected from the group consisting of mechanically roughening said substrate, immersing said substrate in a second electrolyte comprising hydrochloric acid and aluminum chloride which provides aluminum ions, immersing said substrate in a third electrolyte comprising nitric acid and aluminum nitrate which provides aluminum ions, and immersing said substrate in a fourth electrolyte comprising sulfuric acid and aluminum chloride which provides chloride ions, wherein an alternating current is applied to said second, third and fourth electrolytes.

2. A process according to claim 1, comprising performing said primary roughening stage prior to said secondary roughening stage.

3. A process according to claim 1, comprising performing said secondary roughening stage prior to said primary roughening stage.

4. A process according to claim 1, comprising performing said process continuously, wherein said substrate comprises an aluminum or aluminum alloy strip.

5. A process according to claim 4, comprising performing said primary roughening stage at a temperature of about 20° to 60° C. and a current density of about 3 to 180 A/dm².

6. A process according to claim 4, wherein the residence time of an area of said substrate in said first electrolyte is about 10 to 300 seconds.

7. A process according to claim 4, wherein the electrolyte flow velocity on the surface of said substrate is about 5 to 100 cm/second.

8. A process according to claim 1, comprising performing said process discontinuously wherein said substrate comprises an aluminum or aluminum alloy plate.

9. A process according to claim 8, comprising performing said primary roughening stage at a current density of about 3 to 40 A/dm².

10. A process according to claim 8, wherein the residence time of said plate in said first electrolyte is about 30 to 300 seconds.

11. A process according to claim 1, wherein said secondary roughening stage comprises said mechanical roughening, wherein said mechanical roughening comprises wet brushing, wire brushing, sandblasting, bead graining or embossing.

12. A process according to claim 1, wherein said first electrolyte includes sulfuric acid as the source for said sulfate ions.

13. A process according to claim 1, wherein the concentration of said sulfate ions in said first electrolyte is about 5 to 100 gl/l.

14. A process according to claim 13, wherein the concentration of said sulfate ions in said first electrolyte is about 20 to 50 g/l.

15. A process according to claim 1, wherein the concentration of said chloride ions in said first electrolyte is about 1 to 100 g/l.

16. A process according to claim 15, wherein the concentration of said chloride ions in said first electrolyte is about 10 to 70 g/l.

17. A process according to claim 1, wherein said secondary roughening stage comprises immersing said substrate in said second electrolyte, wherein said second electrolyte comprises hydrochloric acid in a concentration of about 1 to 20 g/l and aluminum ions in a concentration of about 10 to 200 g/l.

18. A process according to claim 17, wherein said secondary roughening stage comprises immersing said substrate in said second electrolyte for about 5 to 200 seconds at a temperature of about 35° to 55° C. and applying an alternating current at a current density of about 20 to 150 A/dm$^2$.

19. A process according to claim 1, wherein said secondary roughening stage comprises immersing said substrate in said third electrolyte, wherein said third electrolyte comprises nitric acid in a concentration of about 20 to 35 g/l and aluminum ions in a concentration of about 30 to 50 g/l.

20. A process according to claim 19, wherein said secondary roughening stage comprises immersing said substrate in said third electrolyte for about 2 to 100 seconds at a temperature of about 22° to 50° C. and applying an alternating current at a current density of about 15 to 80 A/dm$^2$.

21. A process according to claim 1, further comprising acidic or alkaline cleaning of said substrate.

22. A process according to claim 21, comprising performing said cleaning prior to said primary and secondary roughening stages.

23. A process according to claim 21, comprising performing said cleaning between said primary and secondary roughening stages.

24. A process according to claim 21, comprising performing said cleaning subsequent to said primary and secondary roughening steps.

25. A process according to claim 21, wherein said cleaning comprises immersing said substrate for about 30 to 80 seconds in an aqueous pickling solution comprised of sodium hydroxide or a mixture of sodium hydroxide and sodium carbonate.

26. A process according to claim 25, wherein said pickling solution comprises sodium hydroxide in a concentration of about 20 g/l and sodium carbonate in a concentration of about 2 g/l.

27. A process according to claim 1, wherein a sinusoidal alternating voltage at mains frequency is employed.

28. A process according to claim 1, wherein a superposed alternating voltage is employed.

29. A process according to claim 1, wherein an alternating voltage having a frequency lower than the mains frequency is employed.

30. A process according to claim 1, wherein said substrate comprises a plate, foil or strip.

31. A process according to claim 1, further comprising, subsequent to said primary and secondary roughening stages, anodic oxidation of said substrate.

32. A process according to claim 1, further comprising, subsequent to said primary and secondary roughening stages, effecting a superficial ablation of the roughened surface of said substrate.

33. A process according to claim 1, further comprising, subsequent to said primary and secondary roughening stages, treating said substrate so as to provide hydrophilic character to said substrate.

34. A process according to claim 1, further comprising, subsequent to said primary and secondary roughening stages, applying a photo-semi-conducting layer to said substrate.

35. An aluminum or aluminum alloy substrate roughened by the process of claim 1.

36. A process for roughening an aluminum or aluminum alloy substrate comprising:

a) a primary roughening stage which comprises immersing said substrate in a first electrolyte comprising sulfate ions and chloride ions, and applying an alternating current to said first electrolyte; and b) a secondary roughening stage which comprises performing at least one roughening step selected from the group consisting of immersing said substrate in a second electrolyte comprising hydrochloric acid and aluminum ions, immersing said substrate in a third electrolyte comprising nitric acid and aluminum ions, and immersing said substrate in a fourth electrolyte comprising sulfuric acid and chloride ions, wherein an alternating current is applied to said second, third and fourth electrolytes.

37. A process according to claim 36, wherein said first electrolyte includes aluminum chloride as the source for said chloride ions, said second electrolyte includes aluminum chloride as the source for said aluminum ions, said third electrolyte includes aluminum nitrate as the source for said aluminum ions, and said fourth electrolyte includes aluminum chloride as the source for said chloride ions.

38. A process according to claim 37, wherein said secondary roughening stage comprises immersing said substrate in said second electrolyte.

39. A process according to claim 37, wherein said secondary roughening stage comprises immersing said substrate in said third electrolyte.

40. A process according to claim 37, wherein said secondary roughening stage comprises immersing said substrate in said fourth electrolyte.

* * * * *